US009169801B2

(12) United States Patent
Mehring et al.

(10) Patent No.: US 9,169,801 B2
(45) Date of Patent: Oct. 27, 2015

(54) INTERNAL COMBUSTION ENGINE WITH OIL-COOLED CYLINDER BLOCK AND METHOD FOR OPERATING AN INTERNAL COMBUSTION ENGINE OF SAID TYPE

(71) Applicant: Ford Global Technologies, LLC, Dearborn, MI (US)

(72) Inventors: Jan Mehring, Cologne (DE); Thomas Lorenz, Cologne (DE); Bernd Steiner, Bergisch Gladbach (DE); Moritz Klaus Springer, Hagen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 32 days.

(21) Appl. No.: 13/948,032

(22) Filed: Jul. 22, 2013

(65) Prior Publication Data

US 2014/0034008 A1 Feb. 6, 2014

(30) Foreign Application Priority Data

Jul. 31, 2012 (DE) ..... 10 2012 213 488

(51) Int. Cl.

| | |
|---|---|
| ***F01M 9/10*** | (2006.01) |
| ***F01M 5/00*** | (2006.01) |
| ***F01P 11/08*** | (2006.01) |
| ***F02F 7/00*** | (2006.01) |

(52) U.S. Cl.

CPC ..... *F02F 7/00* (2013.01)

(58) Field of Classification Search

CPC ..... F01P 2060/04; F01P 3/02; F01P 11/16; F01P 2003/021; F01P 2003/024; F01P 2025/40; F01P 11/08; F01M 11/04; F01M 1/08; F01M 1/16; F01M 5/001; F16N 29/02; F16N 7/40

USPC ..... 123/41.33, 41.4, 196 AB, 196 M, 196 R

See application file for complete search history.

(56) References Cited

U.S. PATENT DOCUMENTS

| | | | | | |
|---|---|---|---|---|---|
| 1,536,499 | A | * | 5/1925 | Horvath | 123/196 AB |
| 2,129,846 | A | * | 9/1938 | Knochenhauer | 123/41.08 |
| 2,162,259 | A | * | 6/1939 | Kennedy | 123/196 R |
| 2,433,420 | A | * | 12/1947 | Booth | 165/297 |
| 3,734,170 | A | * | 5/1973 | Pace | 165/51 |
| 3,779,345 | A | * | 12/1973 | Barnes et al. | 184/6.4 |
| 4,027,643 | A | * | 6/1977 | Feenan et al. | 123/196 AB |
| 4,369,738 | A | * | 1/1983 | Hirayama | 123/41.1 |
| 4,370,950 | A | * | 2/1983 | Furukubo | 123/41.08 |
| 4,410,133 | A | * | 10/1983 | Furukubo | 236/34.5 |
| 4,452,188 | A | * | 6/1984 | Kosuda et al. | 123/90.18 |
| 4,671,463 | A | * | 6/1987 | Moreland et al. | 239/428.5 |
| 4,708,095 | A | * | 11/1987 | Luterek | 123/41.42 |

(Continued)

FOREIGN PATENT DOCUMENTS

| | | | |
|---|---|---|---|
| DE | 3509095 | A1 | 10/1985 |
| DE | 102004047549 | A1 | 4/2006 |
| DE | 102009036603 | A1 | 2/2011 |

*Primary Examiner* — Marguerite McMahon
*Assistant Examiner* — Tea Holbrook
(74) *Attorney, Agent, or Firm* — Julia Voutyras; Alleman Hall McCoy Russell & Tuttle LLP

(57) ABSTRACT

Embodiments for selectively filling a cylinder block cooling jacket with oil are provided. In one example, a control unit may be rotated among a plurality of working positions to open up and/or block flow of oil into and out of the cylinder block cooling jacket.

10 Claims, 4 Drawing Sheets

(56) References Cited

U.S. PATENT DOCUMENTS

| | | | | |
|---|---|---|---|---|
| 4,813,408 | A * | 3/1989 | Katsumoto et al. | 123/196 AB |
| 4,815,419 | A * | 3/1989 | Kitada et al. | 123/41.42 |
| 4,895,219 | A * | 1/1990 | Welch et al. | 184/6.4 |
| 5,067,454 | A * | 11/1991 | Waddington et al. | 123/196 S |
| 5,220,892 | A * | 6/1993 | Boemer | 123/196 AB |
| 5,483,928 | A * | 1/1996 | Mahlberg et al. | 123/41.42 |
| 5,555,856 | A * | 9/1996 | Bauer et al. | 123/41.42 |
| 5,875,633 | A * | 3/1999 | Lawson, Jr. | 60/618 |
| 6,213,080 | B1 * | 4/2001 | Marsh et al. | 123/196 R |
| 6,340,006 | B1 * | 1/2002 | Malatto et al. | 123/41.29 |
| 6,955,150 | B2 * | 10/2005 | Moss | 123/196 AB |
| 7,237,513 | B2 * | 7/2007 | Pfeffinger et al. | 123/41.29 |
| 7,819,093 | B2 * | 10/2010 | Yamashita et al. | 123/41.35 |
| 8,082,893 | B2 * | 12/2011 | Sugiura | 123/41.1 |
| 8,235,022 | B2 * | 8/2012 | Ni et al. | 123/196 CP |
| 8,245,684 | B2 * | 8/2012 | Reynolds et al. | 123/196 R |
| 8,485,222 | B2 * | 7/2013 | Restivo et al. | 137/563 |
| 8,893,669 | B2 * | 11/2014 | Mehring et al. | 123/41.29 |
| 2003/0148679 | A1 * | 8/2003 | Matsuda | 440/88 G |
| 2003/0166363 | A1 * | 9/2003 | Matsuda | 440/88 C |
| 2003/0230274 | A1 * | 12/2003 | Williams et al. | 123/196 R |
| 2004/0031463 | A1 * | 2/2004 | Williams et al. | 123/196 S |
| 2004/0188161 | A1 * | 9/2004 | Yatagai et al. | 180/190 |
| 2005/0039719 | A1 * | 2/2005 | Moss | 123/196 AB |
| 2006/0065218 | A1 * | 3/2006 | Gokan et al. | 123/41.82 R |
| 2007/0074698 | A1 * | 4/2007 | Tawarada et al. | 123/196 R |
| 2007/0095520 | A1 * | 5/2007 | Lorenz et al. | 165/267 |
| 2010/0031915 | A1 * | 2/2010 | Riedel et al. | 123/196 R |
| 2011/0079187 | A1 * | 4/2011 | Steiner et al. | 123/41.82 R |
| 2012/0118248 | A1 * | 5/2012 | Mehring et al. | 123/41.08 |
| 2013/0047940 | A1 * | 2/2013 | Quix et al. | 123/41.08 |
| 2013/0092108 | A1 * | 4/2013 | Mehring et al. | 123/41.72 |
| 2013/0255605 | A1 * | 10/2013 | Jentz et al. | 123/41.15 |
| 2013/0276742 | A1 * | 10/2013 | Mallett | 123/196 R |

* cited by examiner

INTERNAL COMBUSTION ENGINE WITH OIL-COOLED CYLINDER BLOCK AND METHOD FOR OPERATING AN INTERNAL COMBUSTION ENGINE OF SAID TYPE

CROSS REFERENCE TO RELATED APPLICATIONS

The present application claims priority to German Patent Application No. 102012213488.3, filed on Jul. 31, 2012, the entire contents of which are hereby incorporated by reference for all purposes.

FIELD

The disclosure relates to a liquid-cooled internal combustion engine having at least one cylinder head and one cylinder block.

BACKGROUND AND SUMMARY

An internal combustion engine of the above-stated type is used as a drive for motor vehicles. Within the context of the present disclosure, the expression "internal combustion engine" encompasses diesel engines and spark-ignition engines and also hybrid internal combustion engines, that is to say internal combustion engines which are operated using a hybrid combustion process.

Internal combustion engines have at least one cylinder head and one cylinder block which are connected to one another at their assembly end sides so as to form the individual cylinders, that is to say combustion chambers. The cylinder head often serves to hold the valve drive. It is the task of the valve drive to open and close the inlet and outlet openings of the combustion chambers at the correct times.

To hold the pistons or the cylinder liners, the cylinder block has a corresponding number of cylinder bores. The piston of each cylinder of an internal combustion engine is guided in an axially movable manner in a cylinder liner and, together with the cylinder liner and the cylinder head, delimits the combustion chamber of a cylinder. Here, the piston crown forms a part of the combustion chamber inner wall, and together with the piston rings, seals off the combustion chamber with respect to the cylinder block or the crankcase, such that no combustion gases or no combustion air pass into the crankcase, and no oil passes into the combustion chamber.

The piston serves to transmit the gas forces generated by the combustion to the crankshaft. For this purpose, the piston is articulatedly connected by means of a piston pin to a connecting rod, which in turn is movably mounted on the crankshaft.

The crankshaft which is mounted in the crankcase absorbs the connecting rod forces, which are composed of the gas forces as a result of the fuel combustion in the combustion chamber and the mass forces as a result of the non-uniform movement of the engine parts. Here, the oscillating stroke movement of the pistons is transformed into a rotating rotational movement of the crankshaft. Here, the crankshaft transmits the torque to the drivetrain. A part of the energy transmitted to the crankshaft is used for driving auxiliary units such as the oil pump and the alternator, or serves for driving the camshaft and therefore for actuating the valve drive.

Generally, and within the context of the present disclosure, the upper crankcase half is formed by the cylinder block. The crankcase is complemented by the lower crankcase half which can be mounted on the upper crankcase half and which serves as an oil pan. Here, to hold the oil pan, that is to say the lower crankcase half, the upper crankcase half has a flange surface. In general, to seal off the oil pan or the crankcase with respect to the environment, a seal is provided in or on the flange surface. The connection is often provided by means of screws.

To hold and mount the crankshaft, at least two bearings are provided in the crankcase, which bearings are generally of two-part design and comprise in each case one bearing saddle and one bearing cover which can be connected to the bearing saddle. The crankshaft is mounted in the region of the crankshaft journals which are arranged spaced apart from one another along the crankshaft axis and are generally formed as thickened shaft extensions. Here, bearing covers and bearing saddles may be formed as separate components or in one piece with the crankcase, that is to say with the crankcase halves. Bearing shells may be arranged as intermediate elements between the crankshaft and the bearings.

In the assembled state, each bearing saddle is connected to the corresponding bearing cover. In each case one bearing saddle and one bearing cover—if appropriate in interaction with bearing shells as intermediate elements—form a bore for holding a crankshaft journal. The bores are conventionally supplied with engine oil, that is to say lubricating oil, such that a load-bearing lubricating film is ideally formed between the inner surface of each bore and the associated crankshaft journal as the crankshaft rotates—as is the case in a plain bearing. Alternatively, a bearing may also be formed in one piece, for example in the case of a composite crankshaft.

To supply the bearings with oil, a pump for feeding engine oil to the at least two bearings is provided, with the pump supplying engine oil via an oil circuit to a main oil gallery, from which ducts lead to the at least two bearings. To form the main oil gallery, a main supply duct is often provided in the cylinder block, which main supply duct is aligned along the longitudinal axis of the crankshaft.

A pump may be provided with engine oil originating from an oil pan via a suction line which leads from an oil pan to the pump, and said pump may ensure an adequately high feed flow, that is to say an adequately high feed volume, and an adequately high oil pressure in the supply system, that is to say in the oil circuit, in particular in the main oil gallery.

It is also normally necessary for the camshaft receptacle of a valve drive to be supplied with lubricating oil, for which purpose a supply duct is provided. The statements already made above with regard to the crankshaft bearing arrangement apply analogously. Further consumers to be supplied with lubricating oil may for example be the bearings of a connecting rod or the bearings of a balancing shaft which may be provided if appropriate. Likewise a consumer in the above sense is a spray oil cooling arrangement which, for the purpose of cooling, wets the piston crown with engine oil by means of nozzles from below, that is to say at the crankcase side, and therefore uses oil, that is to say is supplied with oil. A hydraulically actuable camshaft adjuster or other valve drive components, for example for hydraulic valve play compensation, likewise have a demand for engine oil and require an oil supply.

The friction in the consumers to be supplied with oil, for example the bearings of the crankshaft or between the pistons and cylinder liners, is dependent significantly on the viscosity and therefore the temperature of the oil which is provided, and said friction contributes to the fuel consumption of the internal combustion engine.

It is fundamentally sought to minimize fuel consumption. In addition to improved, that is to say more effective, combustion, the reduction of friction losses is in the foreground of the efforts being made. Reduced fuel consumption also contributes to a reduction in pollutant emissions.

With regard to reducing friction losses, rapid heating of the engine oil and fast heating-up of the internal combustion engine, in particular after a cold start, is expedient. Fast heating of the engine oil during the warm-up phase of the internal combustion engine ensures a correspondingly fast decrease in viscosity, and therefore a reduction in friction and friction losses.

Previous systems may actively heat the oil by means of an external heating device. The heating device is however an additional consumer with regard to fuel usage, which contradicts the aim of reducing fuel consumption.

In other concepts, the engine oil which is heated during operation is stored in an insulated container and utilized on demand, for example in the event of a re-start of the internal combustion engine. A disadvantage of this approach is that the oil which is heated during operation cannot be kept at a high temperature indefinitely, for which reason re-heating of the oil is generally necessary during the operation of the internal combustion engine.

Both an external heating device and also an insulated container result in an additional installation space requirement in the engine bay, and are detrimental to the attainment of the densest possible packaging of the drive unit.

The reduction of friction losses by means of rapid heating of the engine oil is also hindered in that the cylinder block and the cylinder head are thermally highly loaded components which require effective cooling and which are thus often equipped with cooling jackets for forming a liquid-type cooling arrangement. The thermal management of a liquid-cooled internal combustion engine is then influenced primarily by said cooling arrangement. Here, the cooling arrangement is designed with regard to protecting against overheating and not with regard to the fastest possible heating of the engine oil or of the internal combustion engine after a cold start.

Equipping the internal combustion engine with a liquid-type cooling arrangement requires the provision of coolant ducts which conduct the coolant through the cylinder block, that is to say at least one coolant jacket. Here, the coolant, generally a water-glycol mixture containing additives, is delivered by means of a pump arranged in the cooling circuit, such that said coolant circulates in the coolant jacket. The heat dissipated to the coolant is discharged from the interior of the cylinder block in this way, and is generally extracted from the coolant again in a heat exchanger.

In relation to other coolants, water has the advantage that it is non-toxic, readily available, and cheap, and furthermore has a very high heat capacity, for which reason water is suitable for the extraction and dissipation of very large amounts of heat, which is generally considered to be advantageous. By contrast, disadvantages include the corrosion, associated with water, of the components charged with coolant, and the relatively low maximum admissible coolant temperature, which significantly co-determines the temperature difference between the coolant and the components to be cooled and thus the heat transfer.

If it is sought to extract less heat from the internal combustion engine, in particular from the cylinder block, the use of other cooling liquids, for example of oil, may be expedient. Oil has a lower heat capacity than water and can be heated more intensely, that is to say to higher temperatures, whereby the cooling power can be reduced. The corrosion problem is eliminated. Oil can thus come into direct contact with—in particular moving—components without posing a risk to the functionality of the internal combustion engine.

Furthermore, the use of oil as coolant has further advantages, in particular the advantage that oil-type cooling and the associated coolant jackets may be formed coherently with the oil supply of the internal combustion engine, that is to say a common coherent oil circuit can be formed.

According to the previous systems, for fast heating of the internal combustion engine after a cold start, it is often the case that at least one valve is provided in the coolant circuit which valve prevents the circulation of the coolant in the coolant circuit during the warm-up phase.

Control of the liquid-type cooling arrangement is basically sought with which not only the circulating coolant quantity or the coolant throughput can be reduced after a cold start, but rather also the thermal management of the internal combustion engine heated up to operating temperature can be influenced.

Accordingly, a liquid-cooled internal combustion engine comprises a cylinder block which serves as an upper crankcase half and equipped with at least one integrated coolant jacket; an oil pan which is mounted on the upper crankcase half and which serves as a lower crankcase half provided for collecting and storing oil; at least one coolant jacket connected at an inlet side, for the supply of oil which serves as coolant, via a first supply line to a pump for delivering oil from the oil pan, and at an outlet side, for the discharge of the oil and in order to form an oil circuit, via a first return line to the oil pan, wherein the first return line serves for the gravity-driven discharge of oil whereby at least a part of the oil is, in order to reduce an amount of oil situated in the at least one coolant jacket and thus the cooling power, returned from the at least one coolant jacket of the cylinder block into the oil pan utilizing the force of gravity; a second supply line connecting the pump to a main oil gallery which is provided in the crankcase and which serves for the supply of oil to bearings, wherein the main oil gallery is connected via a second return line, which serves for the gravity-driven discharge of oil, to the oil pan; a discharge line connecting the at least one coolant jacket of the cylinder block to the main oil gallery; and a control unit which has a control drum rotatable about its longitudinal axis between working positions, which control drum in a first working position blocks the first supply line in order to prevent delivery of oil into the at least one coolant jacket of the cylinder block and opens up the second supply line in order to connect the pump to the main oil gallery and supply oil to the bearings.

The internal combustion engine to which the present disclosure relates also has an oil-cooled cylinder block which forms a coherent oil circuit with the oil supply of the internal combustion engine. To form the oil-type cooling arrangement, the cylinder block which serves as an upper crankcase half is equipped with at least one integrated coolant jacket.

The internal combustion engine according to the disclosure has a control drum, by means of the actuation or rotation of which the coolant flow, that is to say the oil flow, can in a suitable way be conducted through the oil circuit or else shut off. In particular, the oil quantity situated in the at least one coolant jacket of the cylinder block can be varied, whereby the amount of heat extracted from the cylinder block by liquid-type cooling can be controlled. The control drum may be of cylindrical form or may have a disk-shaped form, wherein the connections of the lines may then be situated adjacent to the lateral surface of the cylinder or adjacent to the face side of the disk, that is to say may be oriented in the direction of the axis of rotation or transversely with respect to the axis of rotation.

As a result of the discharge of at least a part of the oil by means of a first return line, the cooling power is reduced.

Owing to the reduced cooling power and the resulting reduced heat dissipation, the cylinder block heats up more quickly—for example in the warm-up phase of the internal combustion engine—and with the cylinder block the oil situated in the cylinder block also heats up more quickly, said oil comprising not only the oil situated in the at least one coolant jacket but in particular also the residual oil quantities which remain in the consumers and supply lines of the cylinder block even after the shutdown of the internal combustion engine, for example also the oil film which adheres to a cylinder liner, the viscosity of which oil film significantly co-determines the friction between the piston and cylinder liner.

As a result of the discharge of oil from the block, it is the case even while oil is being circulated not only that the cooling power as a result of convection is reduced but basically also that the thermal mass of the block is reduced by the discharged oil quantity, such that a smaller mass needs to be heated up. In particular, the oil which is discharged into the oil pan does not need to be heated.

The internal combustion engine according to the disclosure utilizes the fact that the oil-cooled cylinder block forms a common oil circuit with the oil supply of the internal combustion engine, and the oil of the cooling arrangement can be discharged out of the cylinder block into the oil pan of the oil supply.

The control according to the disclosure of the liquid-type cooling arrangement requires an open circuit, which in the present case is jointly formed by the oil supply of the internal combustion engine, but which for example could not be formed by a water-type cooling arrangement such as is commonly used in internal combustion engines. In the case of a water-cooled cylinder block, it would be necessary for an extraction point for the discharge of the water, a storage vessel, a delivery pump and the like to be provided. It is pointed out that the cylinder head may basically be water-cooled or else may be part of the oil-type cooling arrangement.

The above-described embodiment of the internal combustion engine in interaction with the use of oil as coolant permits, for the first time, the discharge of the cooling liquid.

In principle, the discharge of oil influences or reduces not only the amount of coolant in the at least one coolant jacket but rather also the heat transfer surface between the oil and the block. The possibility of discharging oil of the liquid-type cooling arrangement from the cylinder block permits cooling of the block according to requirements.

It is also the case in the cooling arrangement according to the disclosure that the pump power, and thus also the coolant throughput, that is to say the delivery volume, can be adjusted. In this way, it is possible to influence the through-flow speed, which significantly co-determines the heat transfer by convection. In this way, it is possible for less or more heat to be extracted from the cylinder block.

The discharge of oil according to the disclosure is to be distinguished from a discharge of the oil via the second return line into the oil pan, wherein the oil quantity situated in the at least one coolant jacket does not change or should not change because the recirculated oil quantity is replaced continuously by oil fed via supply lines.

The internal combustion engine according to the disclosure has proven to be particularly advantageous during the warm-up phase, in particular after a cold start. During a restart of the internal combustion engine, the oil quantity in the cylinder block is preferably at a minimum, for example as a result of oil discharge after a standstill period. The cylinder block warms up relatively quickly owing to the combustion processes taking place, whereby already directly after the start, relatively large amounts of heat are introduced into the residual oil situated in the cylinder block. The oil situated in the cylinder block is consequently heated more quickly and more quickly attains the low viscosity required for lower friction losses. As a result, the fuel consumption of the internal combustion engine is noticeably reduced.

During said heating-up phase, that is to say warm-up phase, the rotatable control drum of the internal combustion engine according to the disclosure is preferably situated in a first working position in which the first supply line is blocked, in order to prevent the delivery of oil into the at least one coolant jacket of the cylinder block. In this way, during the heating-up phase, no oil is delivered through the at least one coolant jacket of the cylinder block, and the oil quantity situated in the cylinder block is kept small and is not enlarged. Here, since the main oil gallery cannot be simultaneously supplied with oil via the cylinder block, the second supply line is opened up in order to connect the pump to the main oil gallery, and to be able to supply oil to the bearings, while bypassing the cylinder block.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
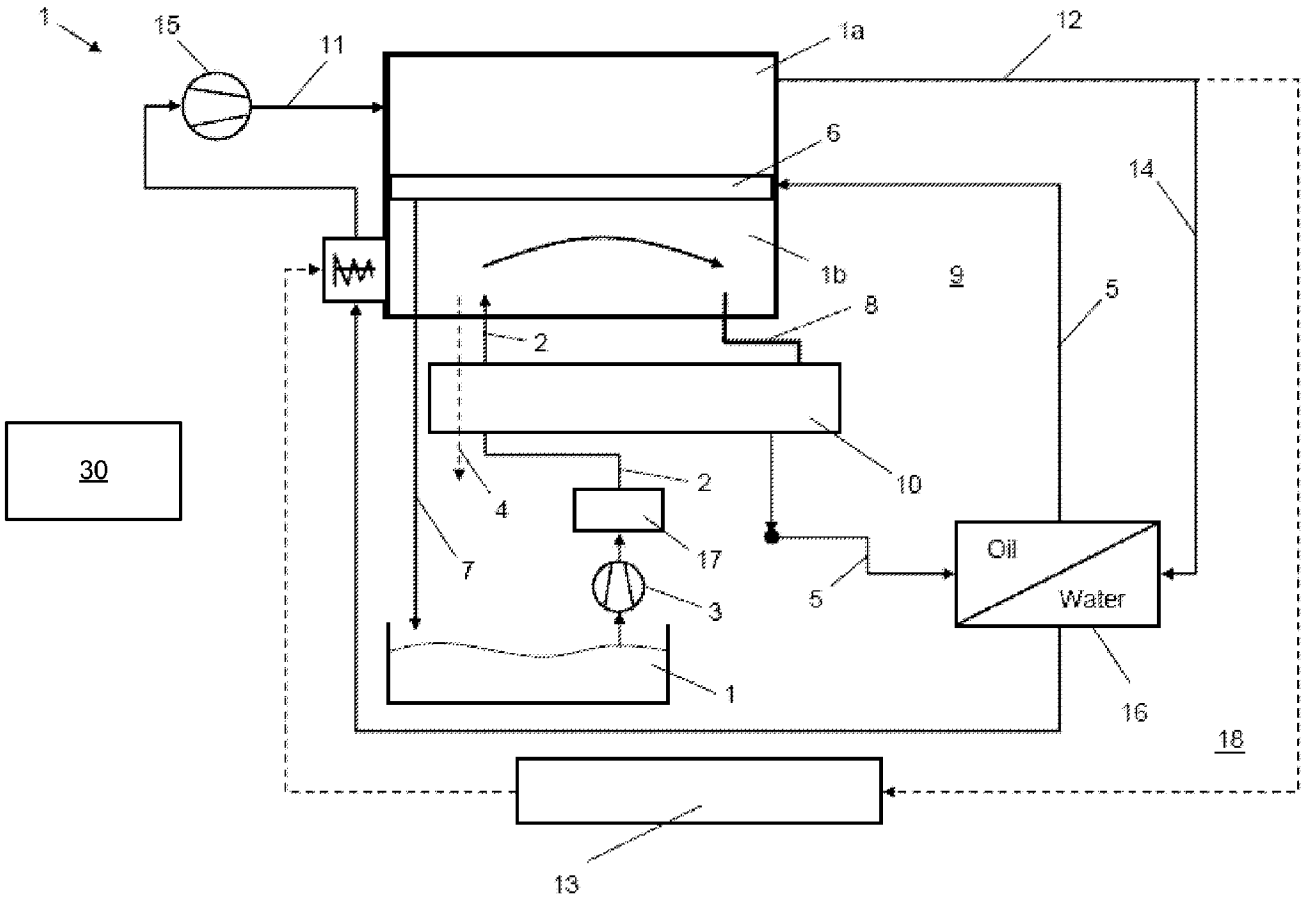
FIG. 1 schematically shows an embodiment of an internal combustion engine.

Embodiments of the liquid-cooled internal combustion engine are advantageous in which, in the installed position of the internal combustion engine, at least three-quarters of the volume of the at least one coolant jacket can be emptied via the first return line.

Embodiments are advantageous in which the control drum can be electrically, hydraulically, pneumatically, mechanically or magnetically controlled, preferably by means of an engine controller.

Embodiments of the liquid-cooled internal combustion engine are advantageous in which the control drum in the first working position blocks the first return line and/or the discharge line.

Since the control drum is preferably situated in the first working position in the warm-up phase and the oil quantity situated in the at least one coolant jacket of the cylinder block in said operating mode of the internal combustion engine is preferably small or minimal, blocking of the first return line or of the discharge line in said scenario is basically not necessary. The coolant jacket has already been substantially emptied by discharging, and further oil cannot pass into the coolant jacket of the block owing to the blocked first supply line.

Nevertheless, the embodiment in question may be advantageous and relevant in practice if, during the warm-up phase, the at least one coolant jacket of the block does not have the minimum realizable coolant level and an oil outflow should be prevented, or the control drum is moved into the first working position outside the warm-up phase.

Embodiments of the liquid-cooled internal combustion engine are advantageous in which the control drum in a second working position opens up the first supply line in order to deliver oil into the at least one coolant jacket of the cylinder block. The second working position preferably serves for the filling of the at least one coolant jacket, preferably after the end of the warm-up phase. The movement of the control drum into the second working position basically serves for the increase of the oil quantity situated in the at least one coolant jacket.

In this connection, embodiments of the liquid-cooled internal combustion engine are advantageous in which the control drum in the second working position blocks the first return line. The blocking of the first return line in the second working position assists or accelerates the filling of the at least one coolant jacket, specifically by virtue of a discharge of oil via the first return line being prevented.

For the same reason, embodiments of the liquid-cooled internal combustion engine are also advantageous in which the control drum in the second working position blocks the discharge line. The blocking of the discharge line in the second working position likewise assists or accelerates the filling of the at least one coolant jacket, because an oil outflow via the discharge line is prevented.

In the present connection, embodiments of the liquid-cooled internal combustion engine are also advantageous in which the control drum in the second working position opens up the second supply line in order to connect the pump to the main oil gallery and supply oil to the bearings. Said embodiment ensures that the main oil gallery and the bearings are adequately supplied with oil even during the filling of the coolant jacket of the cylinder block.

Embodiments of the liquid-cooled internal combustion engine may however also be advantageous in which the control drum in the second working position blocks the second supply line. The blocking of the second supply line in the second working position assists or accelerates the filling of the at least one coolant jacket because all of the oil delivered by the pump is delivered or passes into the coolant jacket of the cylinder block.

Embodiments of the liquid-cooled internal combustion engine are advantageous in which the control drum in the second working position opens up a ventilation line in order that air can escape from the at least one coolant jacket during the filling of the at least one coolant jacket with oil. The air displaced during the filling with oil can exit the at least one coolant jacket of the cylinder block via the ventilation line and thus make way for the oil being delivered in.

Embodiments of the liquid-cooled internal combustion engine are advantageous in which the control drum in a third working position opens up the first supply line in order to deliver oil into the at least one coolant jacket of the cylinder block and opens up the discharge line in order to connect the at least one coolant jacket of the cylinder block to the main oil gallery.

The third working position of the control drum characterizes the liquid-type cooling of the cylinder block after the end of the warm-up phase of the internal combustion engine and after the end of the filling of the coolant jacket, that is to say the status of the cooling control during normal operation of the heated-up internal combustion engine, wherein a start-stop strategy, for example the shutting-down of the internal combustion engine while the vehicle is at a standstill and restarting, may be regarded as falling within normal operation. In the third working position, oil is supplied continuously to the at least one coolant jacket of the cylinder block via the first supply line. The oil flows through the cylinder block, extracts heat from the block, and passes via the discharge line out of the cylinder block and to the main oil gallery.

In this connection, embodiments of the liquid-cooled internal combustion engine are advantageous in which the control drum in the third working position blocks the first return line. The blocking of the first return line in the third working position may be advantageous if the greatest possible coolant throughput is sought or required downstream of the at least one coolant jacket, for example in the discharge line, second supply line and/or the main oil gallery. The prevention of a return of oil via the first return line assists efforts to increase or maximize the relevant coolant throughput.

An embodiment of the internal combustion engine in which the greatest possible coolant throughput could be sought at least at times is an internal combustion engine in which, downstream of the at least one coolant jacket, a heat exchanger is provided through which the second supply line and a further liquid-conducting line lead and in which the oil which serves as coolant interacts, that is to say exchanges heat, with the other liquid for example in order to warm up the oil during the warm-up phase of the internal combustion engine. Here, the other liquid could be cooling water from a liquid-cooled cylinder head.

Here, embodiments of the liquid-cooled internal combustion engine are also advantageous in which the control drum in the third working position blocks the second supply line. The blocking of the second supply line in the third working position increases the coolant throughput through the at least one coolant jacket of the cylinder block and thereby increases the heat extraction by convection. It may be taken into consideration here that the second supply line functions as a bypass line which conducts the oil past the cylinder block, that is to say allows the at least one coolant jacket of the cylinder block to be bypassed.

Embodiments of the liquid-cooled internal combustion engine are advantageous in which the control drum in a fourth working position opens up the first return line for the gravity-driven discharge of the oil.

The control drum is preferably moved, that is to say rotated, into the fourth working position when the internal combustion engine is shut down, specifically not automatically within the context of a start-stop strategy in which a restart takes place after a short time and autonomously, but rather when shutting down is performed purposely by the driver. The movement of the control drum into the fourth working position serves for the discharge of oil from the at least one coolant jacket of the cylinder block, that is to say the emptying of the coolant jacket. As a result of the discharge of oil from the block, the thermal mass of the block is reduced by the discharged oil quantity, such that a smaller mass needs to be heated up upon a restart.

When the internal combustion engine is restarted, the rotatable control drum is situated in the first working position again, in which the first supply line is blocked in order to prevent the delivery of oil into the at least one coolant jacket of the cylinder block. During the warm-up phase, no oil flows through the at least one coolant jacket of the cylinder block, whereby the cooling power is minimized. Oil is supplied to the main oil gallery by means of the second supply line.

Here, embodiments of the liquid-cooled internal combustion engine are advantageous in which the control drum in the fourth working position opens up a ventilation line in order that air can pass into the at least one coolant jacket of the cylinder block during the gravity-driven discharge of the oil.

Embodiments of the liquid-cooled internal combustion engine are advantageous in which the at least one cylinder head is equipped with at least one integrated coolant jacket, wherein said at least one coolant jacket has, at the inlet side, a feed line for the supply of coolant and, at the outlet side, in order to form a coolant circuit, a third return line for the return of the coolant, wherein the third return line can at least be connected to the feed line.

Like the cylinder block, the cylinder head may also be equipped with one or more coolant jackets. The cylinder head is generally the thermally more highly loaded component because, by contrast to the cylinder block, the head is provided with exhaust-gas-conducting lines, and the combustion chamber walls which are integrated in the head are exposed to hot exhaust gas for longer than the cylinder liners provided in the cylinder block. Furthermore, the cylinder head has a lower component mass than the block.

For this reason, it is also advantageous for a water-glycol mixture containing additives to be used as coolant, that is to say for the cooling arrangement of the head to be formed as a water-type cooling arrangement. Water has the advantage over other coolants of having a very high heat capacity, as has already been mentioned further above.

In this context, embodiments of the liquid-cooled internal combustion engine are advantageous in which a heat exchanger is arranged in the third return line, by means of which heat exchanger the previously absorbed heat can be extracted again from the coolant conducted through the head.

Here, embodiments of the liquid-cooled internal combustion engine are advantageous in which a bypass line is provided which branches from the third return line upstream of the heat exchanger and which can at least be connected to the feed line. The bypass line serves for bypassing the heat exchanger, which is advantageous in the context of the warm-up phase, when no heat should be extracted from the coolant but rather the fastest possible heating of the coolant and thus of the internal combustion engine is sought.

Here, embodiments of the liquid-cooled internal combustion engine are advantageous in which a second heat exchanger is provided through which the bypass line and the second supply line leads. The oil situated in the second supply line can, upon flowing through the second heat exchanger, interact with, for example absorb heat from, the cylinder head coolant which flows through the bypass line. In the latter case, the heat exchanger functions as a coolant-operated oil heater.

The method for operating a liquid-cooled internal combustion engine of an above-described type is achieved by means of a method which is characterized in that the control drum is moved from the first working position, which serves for the fast heating of the cylinder block, into the second working position in order to fill the at least one coolant jacket of the cylinder block with oil.

That which has already been stated with regard to the internal combustion engine according to the disclosure also applies to the method according to the disclosure. Relevant method variants arise corresponding to the different embodiments of the internal combustion engine.

FIG. 1 shows an embodiment of the internal combustion engine 1 together with oil circuit 9 and water circuit 18. The internal combustion engine 1 comprises a cylinder head 1*a* and a cylinder block 1*b*.

The cylinder block 1*b* which serves as an upper crankcase half is equipped with an integrated coolant jacket in order to form an oil-type cooling arrangement. An oil pan 1*c* that can be mounted on the cylinder block 1*b* serves for collecting and storing the engine oil, that is to say oil.

Oil which originates from the oil pan 1*c* and which serves as coolant can be supplied to the coolant jacket integrated in the cylinder block 1*b* via a first supply line 2 by means of a pump 3. A first return line 4 which can at least be connected to the oil pan 1*c* serves for the gravity-driven discharge of the oil from the coolant jacket. As a result of the discharge of oil, the oil quantity situated in the coolant jacket and thus the cooling power of the cylinder block 1*b* can be reduced. For cleaning the oil, a filter 17 is provided downstream of the pump 3.

The lines need not be lines in the actual sense but rather may be partially or completely integrated in the cylinder head and/or cylinder block. In particular, the second return line is generally a line not in the actual sense but rather in the figurative sense. The oil which is delivered via the main oil gallery into the bearings, for example into the connecting rod bearings and the crankshaft bearings, generally drips back into the oil pan under the force of gravity, such that, in effect, the crankcase region through which the oil drips back forms the second return line, and the second return line illustrated in FIG. 1 symbolizes the oil return more as a measure than a physical oil return line.

Within the context of the present disclosure, the wording "can at least be connected" should be interpreted as meaning that either a permanent connection exists or else a connection can be produced, for example lines or the like can at least be connected if they are not already permanently connected to one another.

The pump 3 can additionally or alternatively be connected via a second supply line 5 to a main oil gallery 6 provided in the crankcase. The main oil gallery 6 serves for the supply of oil to bearings and is permanently connected to the oil pan 1*c* via a second return line 7 which serves for the gravity-driven discharge of oil. The coolant jacket of the cylinder block 1*b* can likewise be connected to the main oil gallery 6 via a discharge line 8 and the second supply line 5.

To open up or block the lines 2, 4, 5 and 8, a control unit 10, otherwise referred to as a proportional valve, is provided which has a control drum rotatable about its longitudinal axis between working positions. The control drum is not illustrated in FIG. 1 but is explained in more detail below.

In a first working position, the control drum blocks the first supply line 2 in order to prevent the delivery of oil into the coolant jacket of the cylinder block 1*b*. When the coolant jacket has been emptied of oil, the first working position is suitable for the heating-up of the block during the warm-up phase of the internal combustion engine 1. By contrast, the second supply line 5 is opened up in order to supply oil originating from the oil pan 1*c* to the main oil gallery 6 and to the bearings.

In a second working position, the control drum opens up the first supply line 2 in order to deliver oil into the coolant jacket of the cylinder block 1*b*. Proceeding from an emptied coolant jacket and a control drum in the first working position, the rotation of the drum into the second working position serves for the filling of the coolant jacket, for which reason it is also the case that the control drum in the second working position preferably blocks the first return line 4 and the discharge line 8.

In a third working position, the control drum opens up the first supply line 2 and the discharge line 8, such that oil can flow through the coolant jacket of the cylinder block 1*b* for the purpose of cooling (indicated by the curved arrow).

In a fourth working position, the first return line 4 is opened up for the gravity-driven discharge of oil in order to empty the coolant jacket.

The cylinder head 1*a* of the internal combustion engine 1 is likewise liquid-cooled and equipped with an integrated coolant jacket which is supplied with coolant, that is to say with water, at the inlet side via feed line 11. To form a coolant circuit 18, a third return line 12 is provided which can be connected to the feed line 11 and which serves for the return of the coolant from the outlet side to the inlet side. A pump 15 for delivering the water is arranged at the inlet side in the feed line 11.

A heat exchanger 13 is arranged in the third return line 12, wherein a bypass line 14 is provided which branches from the third return line 12 upstream of the heat exchanger 13 and which is connected to the feed line 11.

A second heat exchanger 16 serves for the exchange of heat between the two cooling liquids, that is to say between the water and the oil. For this purpose, both the bypass line 14 and also the second supply line 5 lead through the heat exchanger 16.

In order to adjust a position of the proportional valve 10, a controller 30 is provided. Controller 30 is shown in FIG. 1 as a conventional microcomputer including a microprocessor unit, input/output ports, read-only memory, random access memory, keep alive memory, and a conventional data bus. Controller 30 may receive various signals from sensors coupled to the engine including: engine coolant temperature (ECT) from a temperature sensor coupled to cooling sleeve; a measurement of engine manifold pressure (MAP) from a pressure sensor coupled to an intake manifold of the engine; an engine position sensor from a Hall effect sensor sensing crankshaft position; a measurement of air mass entering the engine from a sensor (e.g., a hot wire air flow meter); and a measurement of throttle position from a throttle position sensor. In an aspect of the present description, an engine position sensor produces a predetermined number of equally spaced pulses every revolution of the crankshaft from which engine speed (RPM) can be determined.

Figure 2:
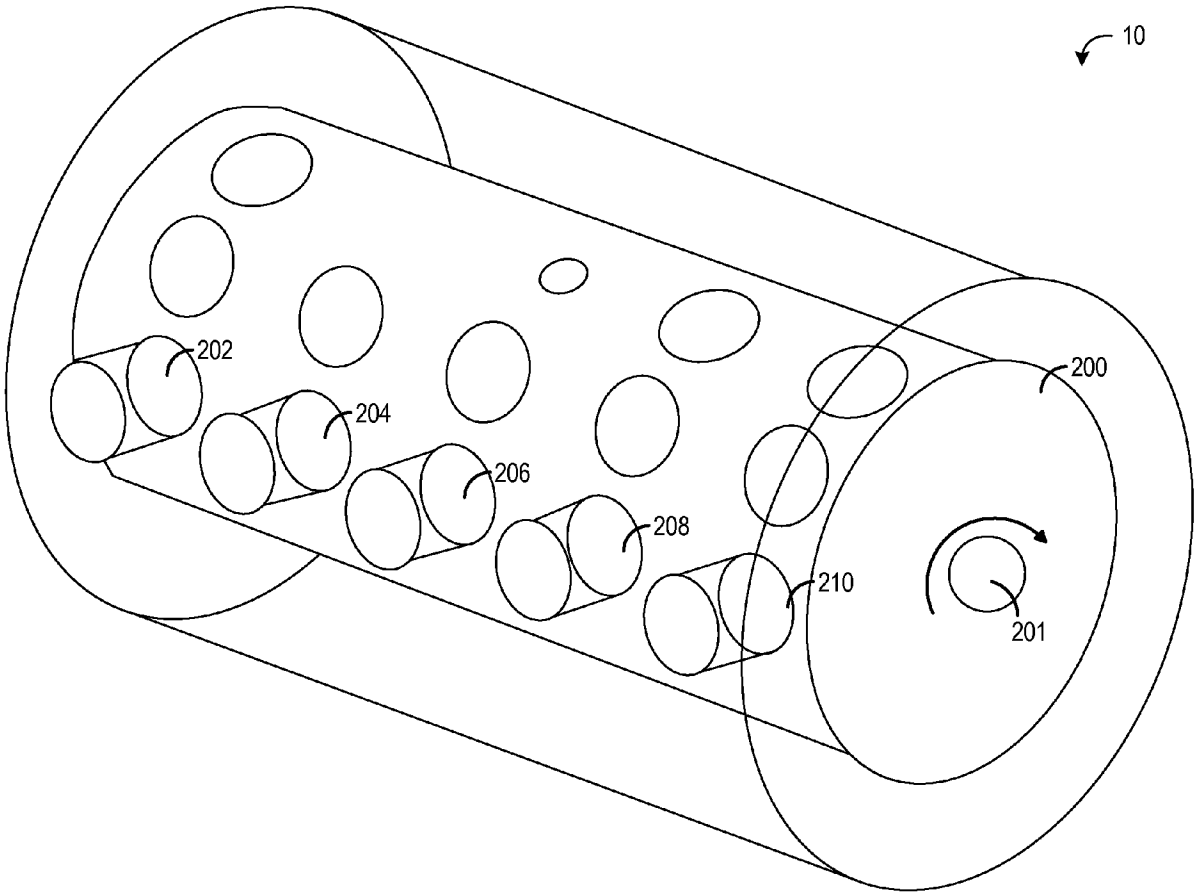
FIG. 2 schematically shows an example proportional valve controlling flow of oil through the engine of FIG. 1.

FIG. 2 schematically shows an example of a proportional valve (e.g., control unit 10 of FIG. 1) configured to control oil flow in an engine. As shown, the valve includes a control drum 200 rotatable about a longitudinal axis 201. The valve also includes a plurality of inlet and outlet ports. For example, as shown in FIG. 2, the valve includes an air ventilation outlet 202, an oil drain outlet 204, a main oil gallery outlet 206, and two oil pump inlets 208 and 210. Further, while not shown in FIG. 2, the valve also includes an air ventilation inlet, oil drain inlet, cylinder block cooling jacket inlet, cylinder block cooling jacket outlet, and main oil gallery outlet. In one example, depending on the position of the control drum, the air ventilation inlet may align with and lead out to the air ventilation outlet 202 such that air from the cylinder block cooling jacket can be ventilated during filling of the cooling jacket. Similarly, the oil drain inlet may be aligned with and lead to the oil drain outlet 204, the cylinder block cooling jacket inlet may align with and lead to the main oil gallery outlet 206, the oil pump inlet 208 may align with and lead to the cylinder block cooling jacket outlet, and the oil pump inlet 210 may align with and lead to the main oil gallery outlet.

When the control drum is rotated (via a signal sent from the engine controller 30, for example), one or more of the inlet/outlet ports may be blocked. For example, in the first working position, the oil pump inlet 208 and/or the cylinder block cooling jacket outlet may be blocked so that oil is blocked from entering the cylinder block. However, the oil pump inlet 210 may be aligned with the oil gallery outlet to provide lubricating oil to the oil gallery and one or more oil consumers, such as the bearings.

In the second working position, the oil pump inlet 208 and the cylinder block cooling jacket outlet may be aligned so that oil can be routed to the cylinder block cooling jacket. To prevent drainage out of the cylinder block cooling jacket, when the valve is in the second working position, the oil drain outlet 204 may be blocked. In contrast, the third working position of the valve may allow flow from the oil pump to both the main oil gallery and cylinder block cooling jacket while allowing oil to drain from the cylinder block to the oil sump via the oil drain outlet. In a fourth working position, the oil drain outlet may be opened up while the cylinder block cooling jacket inlet is blocked in order to drain oil from the cylinder block cooling jacket.

The location of the inlet/outlet ports, and alignment thereof in each working position, may be positioned to minimize back and forth movement of the valve body (e.g., control drum) when transitioning among various modes. For example, as explained in more detail below, the valve may be configured to rotate from the first working position to the second working position responsive to engine temperature reaching a threshold. Then, after the cylinder block cooling jacket is filled with oil, the valve may be rotated to the third working position. Finally, responsive to engine shutdown, the valve may be rotated to the fourth working position to drain the oil from the block cooling jacket. When the engine is subsequently started up again, the valve may be rotated back to the first working position to maintain flow of oil to the main oil gallery while blocking flow of oil to the cylinder block cooling jacket. As such, the first working position may be a position of the valve between the fourth working position and the second working position to minimize rotation of the valve when transitioning between the various modes.

Figure 3A:
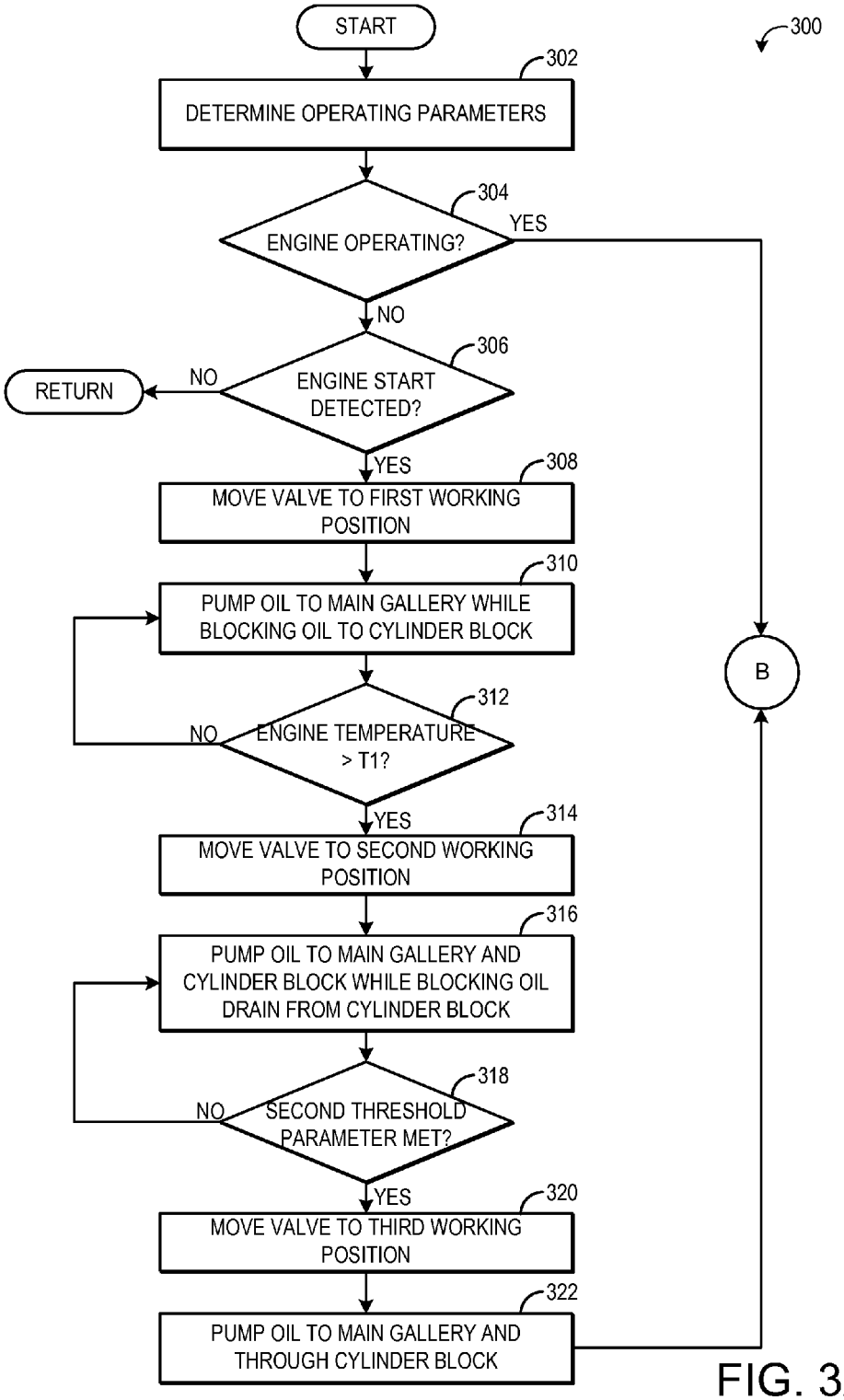
FIGS. 3A-3B show a flow chart illustrating a method for routing oil through the engine of FIG. 1 using the proportional valve of FIG. 2.
Figure 3B:
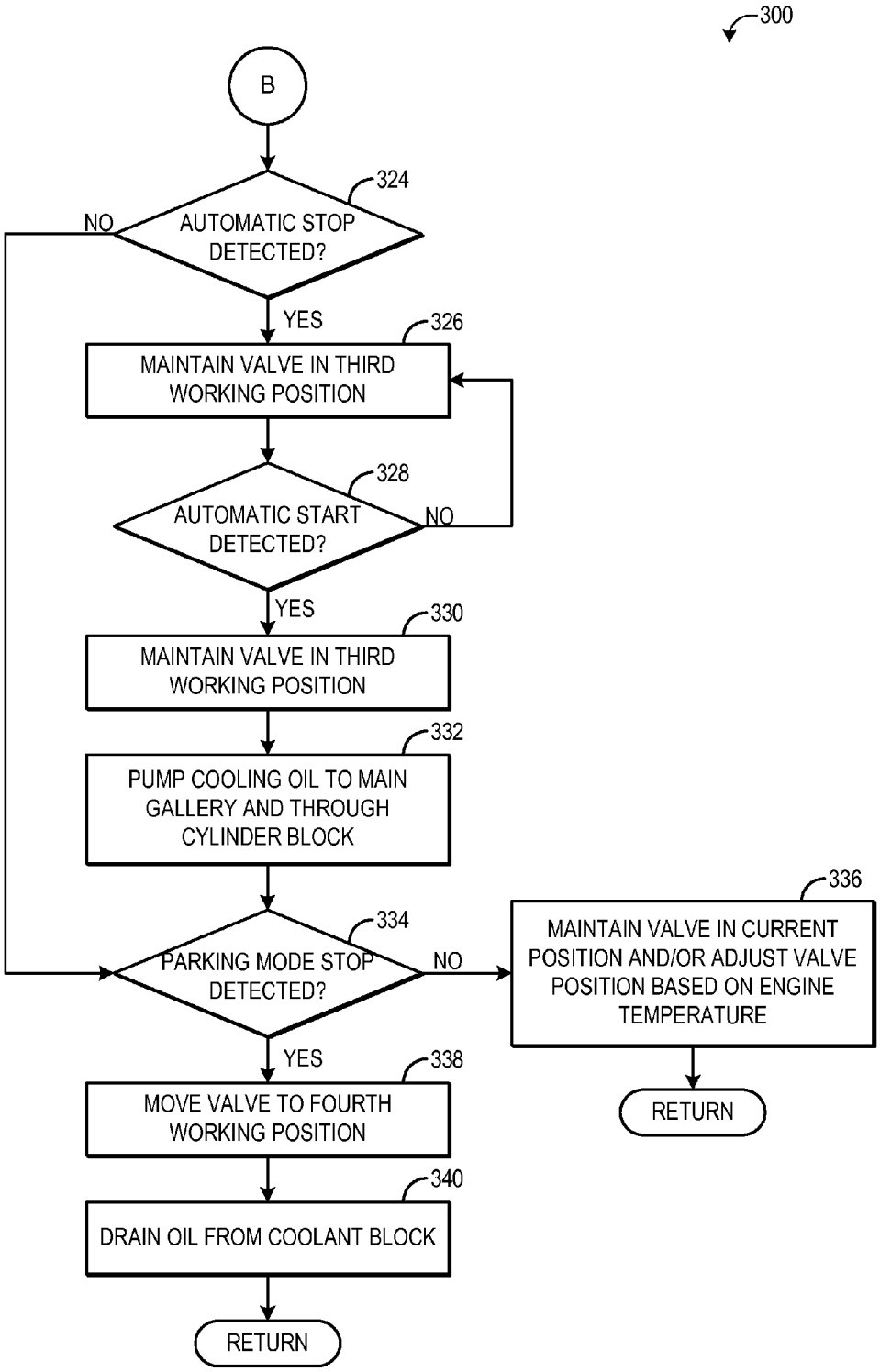

Turning now to FIGS. 3A-3B, a method 300 for controlling flow of oil through an engine system is provided. In one example, method 300 may be carried out by controller 30 according to instructions stored thereon in order to selectively route oil to a cooling jacket of cylinder block 1*b* using proportional valve 10.

At 302, method 300 includes determining engine operating parameters. The determined operating parameters may include, but are not limited to, engine operating status, fuel injection status, engine temperature, engine speed and load, accelerator pedal position, brake pedal position, and other parameters. At 304, it is determined if the engine is operating. Engine operation may be determined based on ignition key position, fuel injection status, etc. If the engine is operating, method 300 proceeds to 324 of FIG. 3B, which will be explained below.

If the engine is not operating, at 306 method 300 judges if an engine start is detected, for example by determining if an ignition key is turned to the on position, if a starter motor is being operated, or other parameters. If a start is not detected, method 300 returns. If a start is detected, method 300 proceeds to 308 to move the proportional valve to the first working position and pump oil to the main oil gallery while blocking oil from reaching the cylinder block cooling jacket at 310. By doing so, the cylinder block may be rapidly warmed while still providing lubricating oil to one or more oil consumers (e.g., bearings) via the main oil gallery.

At 312, method 300 determines if the engine temperature has reached a first threshold. The first threshold may be a suitable temperature, such as near normal engine operating temperature (e.g., 150° C.). The first threshold temperature may be a temperature at which the cylinder block requires cooling from cooling oil provided in the cooling jacket in order to prevent engine overheating. If the engine temperature has not reached the first threshold, method 300 returns to 310 to continue to pump oil to the gallery while blocking oil from reaching the cylinder block cooling jacket.

If the engine has reached the first threshold temperature, method 300 proceeds to 314 to move the proportional valve to the second working position. At 316, oil is pumped to the main oil gallery and to the cylinder block cooling jacket while oil is blocked from one or more of the return line leading to a heat exchanger and oil gallery and draining out of the cylinder block cooling jacket and to the oil sump. This will rapidly fill the cylinder block cooling jacket with oil.

At 318, method 300 determines if a second threshold parameter has been met. The second threshold parameter may be a suitable parameter that indicates the cylinder block cooling jacket has been filled with oil. In one example, the threshold parameter may be an elapsed amount of time since moving the valve to the second working position. In another example, the threshold parameter may an oil pressure of oil downstream of the oil pump. Once the cylinder block cooling jacket is full of oil, the pressure in the line leaving the pump will increase, and if the pressure reaches a threshold amount, it may be determined that the block cooling jacket is full of oil. Other threshold parameters are possible, such as engine temperature.

If the second threshold parameter has not been met, method 300 loops back to 316 to continue to operate with the valve in the second working position to fill the block jacket with oil. If the second threshold parameter has been met and the cylinder block cooling jacket is full of oil, method 300 proceeds to 320 to move the valve to the third working position, and at 322, pump oil to the main oil gallery and through the cylinder block cooling jacket. The oil pumped through the block jacket will also be routed through the return line to a heat exchanger (e.g., oil/water exchanger 16) to cool the oil. The oil is then routed to the main oil gallery before being drained to the oil sump, where the pump pumps the oil to the cylinder block cooling jacket and main oil gallery.

Method 300 then proceeds to 324 of FIG. 3B and determines if an automatic stop is being performed. During an automatic stop, the engine is temporarily shut down to conserve fuel during conditions where engine torque is not needed, such as when the vehicle is stopped at a stop light. An automatic stop may be detected when the ignition key is left on and fuel injection stops. Alternatively or additionally, an automatic stop may be detected based on engine speed and load, accelerator pedal position, and/or brake pedal position. If an automatic stop is not detected, method 300 proceeds to 334, explained below. If an automatic stop is detected, method 300 proceeds to 326 to maintain the proportional valve in the third working position. At 328, it is determined if an automatic start is detected, where the engine is automatically started in anticipation of a subsequent torque request. For example, if the vehicle operator lifts the brake pedal and presses the accelerator pedal, the engine may be automatically started.

If an automatic start is not detected, method 300 loops back to 326 to maintain the valve in the third working position. If an automatic start is detected, at 330 the valve is maintained in the third working position and at 332, oil is pumped to the main gallery and through the cylinder block cooling jacket.

At 334, it is determined if a parking mode stop is detected. The parking mode stop may include a prediction that the engine is about to be shut down for a longer duration than during an automatic stop. The parking mode stop may be detected when the vehicle is placed into park, when the ignition key is turned off, and/or when fuel injection is suspended, etc. If a parking mode stop is not detected, method 300 proceeds to 336 to maintain the valve in its current position (e.g., the third working position) and/or adjust the valve position based on engine temperature as explained above. Method 300 then returns.

If a parking mode stop is detected, at 338 the proportional valve is moved to a fourth working position and at 340 oil is drained from the cylinder block cooling jacket to the oil sump. It this way, during engine shutdown the oil may be collected in the sump and removed from the cylinder block cooling jacket so that during a subsequent engine start, the cylinder block may be rapidly heated before oil is pumped to the block cooling jacket. Method 300 then returns.

Thus, the system and method described here provide for a method for an engine comprising during a first warm-up phase, blocking oil from entering a cylinder block cooling jacket of the engine; during a second warm-up phase, routing oil to the cylinder block cooling jacket while blocking return of the oil from the cylinder block cooling jacket to a heat exchanger; and during warmed-up engine operation, routing oil through the cylinder block cooling jacket and to the heat exchanger.

The first warm-up phase may occur when the engine is operating below a desired operating temperature, such as normal warmed-up engine temperature or below a catalyst light-off temperature. Then, when the desired temperature is reached, the second warm-up phase may be initiated, where the cylinder block cooling jacket is filled with oil. Following the jacket being filled with oil, the warmed-up operating phase may be carried out, where the engine oil is routed to the cylinder block cooling jacket. Heat transferred from the cylinder block to the oil may be dissipated to atmosphere via a heat exchanger.

To block oil from entering the cylinder block cooling jacket, the oil may be routed through a proportional valve in a first working position. Responsive to engine temperature reaching a threshold temperature, the proportional valve may be rotated from the first working position to a second working position to route oil to the cylinder block. Responsive to the oil filling the cylinder block cooling jacket, the proportional valve may be rotated to a third working position to route the oil through the cylinder block cooling jacket and to the heat exchanger.

Following shutdown of the engine, the oil may be drained from the cylinder block cooling jacket to the oil sump, via the proportional valve in a fourth working position. During substantially all engine operating conditions (e.g., during the first-warm up phase, the second warm-up phase, and warmed up engine operation), the oil is routed to a main engine oil gallery to supply one or more oil consumers with lubricating oil.

Another method for an engine comprises blocking oil from entering an engine cylinder block cooling jacket by moving a proportional valve to a first working position; routing the oil to the cylinder block cooling jacket while blocking drainage of the oil from the cylinder block cooling jacket by moving the proportional valve to a second working position; and routing the oil through the cylinder block cooling jacket and returning the oil to a heat exchanger by moving the proportional valve to a third working position.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an engine, comprising:

during a first engine warm-up phase, blocking cooling oil from entering a cylinder block cooling jacket of an engine;

during a second engine warm-up phase, routing cooling oil to the cylinder block cooling jacket while blocking return of the cooling oil from the cylinder block cooling jacket to a heat exchanger;

during warmed-up engine operation, routing cooling oil through the cylinder block cooling jacket and to the heat exchanger; and, wherein routing cooling oil to the cylinder block cooling jacket while blocking return of the cooling oil from the cylinder block cooling jacket to the heat exchanger comprises routing the cooling oil through a proportional valve in a second working position, where in the second working position, the proportional valve opens a cylinder block outlet to flow cooling oil to the cylinder block cooling jacket and blocks an oil drain outlet of the proportional valve to block return of the cooling oil from the cylinder block cooling jacket, and where in the second position, an oil pump inlet is aligned with a gallery outlet to allow lubricating oil to flow to a main engine oil gallery and one or more oil consumers.

2. The method of claim 1, further comprising: following shutdown of the engine, draining the cooling oil from the cylinder block cooling jacket to an oil sump, and during substantially all engine operating conditions, routing lubricating oil from the oil sump to the main engine oil gallery to supply one or more oil consumers with lubricating oil.

3. The method of claim 1, wherein blocking cooling oil from entering the cylinder block cooling jacket comprises routing the cooling oil through the proportional valve in a first working position, and further comprising: responsive to engine temperature reaching a threshold temperature, rotating the proportional valve from the first working position to the second working position to route cooling oil to the cylinder block; and responsive to the cooling oil filling the cylinder block cooling jacket, rotating the proportional valve to a third working position to route the cooling oil through the cylinder block cooling jacket and to the heat exchanger.

4. The method of claim 1, wherein blocking cooling oil from entering the cylinder block cooling jacket comprises routing the cooling oil through the proportional valve in a first working position, where in the first working position, the proportional valve blocks the cylinder block outlet of the proportional valve to block cooling oil from entering the cylinder block cooling jacket while aligning the oil pump inlet with the oil gallery outlet to allow lubricating oil to flow to the main engine oil gallery and one or more oil consumers.

5. A method for an engine, comprising: blocking oil from entering an engine cylinder block cooling jacket by moving a proportional valve to a first working position; routing the oil to the cylinder block cooling jacket while blocking drainage of the oil from the cylinder block cooling jacket by moving the proportional valve to a second working position; and routing the oil through the cylinder block cooling jacket and returning the oil to a heat exchanger by moving the proportional valve to a third working position; and, wherein routing cooling oil to the cylinder block cooling jacket while blocking return of the cooling oil from the cylinder block cooling jacket to the heat exchanger comprises routing the cooling oil through the proportional valve in the second working position, where in the second working position, the proportional valve opens a cylinder block outlet to flow cooling oil to the cylinder block cooling jacket and blocks an oil drain outlet of the proportional valve to block return of the cooling oil from the cylinder block cooling jacket, and where in the second position, an oil pump inlet is aligned with a gallery outlet to allow lubricating oil to flow to a main engine oil gallery and one or more oil consumers.

6. The method of claim 1, wherein routing cooling oil through the cylinder block cooling jacket and to the heat exchanger comprises routing the cooling oil through the proportional valve in a third working position, where in the third working position, the proportional valve opens the cylinder block outlet to flow cooling oil to the cylinder block cooling jacket and opens the oil drain outlet to allow return of the cooling oil from the cylinder block cooling jacket, and where in the third position, the oil pump inlet is aligned with the oil gallery outlet to allow lubricating oil to flow to the main engine oil gallery and one or more oil consumers.

7. The method of claim 6, further comprising, following shutdown of the engine, draining the cooling oil from the cylinder block cooling jacket to an oil sump through the proportional valve in a fourth working position, where in the fourth working position, the oil drain outlet is open and the cylinder block outlet is closed.

8. The method of claim 5, wherein blocking oil from entering the engine cylinder block cooling jacket by moving the proportional valve to the first working position comprises moving the proportional valve to the first working position responsive to detecting an engine start.

9. The method of claim 5, wherein routing the oil to the cylinder block cooling jacket while blocking drainage of the oil from the cylinder block cooling jacket by moving the proportional valve to the second working position comprises moving the proportional valve to the second working position responsive to engine temperature reaching a threshold temperature.

10. The method of claim 5, wherein routing the oil through the cylinder block cooling jacket and returning the oil to the heat exchanger by moving the proportional valve to the third working position comprises moving the proportional valve to the third working position responsive to oil filling the cylinder block cooling jacket.

* * * * *